US009334730B2

(12) United States Patent
Sanan et al.

(10) Patent No.: US 9,334,730 B2
(45) Date of Patent: May 10, 2016

(54) TIPS FOR PICK TOOLS AND PICK TOOLS COMPRISING SAME

(75) Inventors: Matthew Alan Sanan, Springs (ZA); Cornelis Roelof Jonker, Springs (ZA)

(73) Assignee: Element Six Abrasives S.A., Luxembourg (LU)

( * ) Notice: Subject to any disclaimer, the term of this patent is extended or adjusted under 35 U.S.C. 154(b) by 172 days.

(21) Appl. No.: 14/234,468

(22) PCT Filed: Jul. 25, 2012

(86) PCT No.: PCT/EP2012/064609
§ 371 (c)(1), (2), (4) Date: Jan. 23, 2014

(87) PCT Pub. No.: WO2013/014192
PCT Pub. Date: Jan. 31, 2013

(65) Prior Publication Data

US 2014/0139008 A1 May 22, 2014

Related U.S. Application Data

(60) Provisional application No. 61/512,531, filed on Jul. 28, 2011.

(30) Foreign Application Priority Data

Jul. 28, 2011 (GB) ..... 1113013.5

(51) Int. Cl.
*E21C 35/183* (2006.01)
*E21C 35/18* (2006.01)
(Continued)

(52) U.S. Cl.
CPC ..... *E21C 35/18* (2013.01); *E21B 10/5673* (2013.01); *E21B 10/5735* (2013.01); *E21C 35/183* (2013.01)

(58) Field of Classification Search
CPC ..... E21C 2035/1803; E21C 35/183
USPC ..... 175/420.1, 420.2, 426, 428, 430, 431, 175/432, 434; 299/111, 112 T, 113, 105
See application file for complete search history.

(56) References Cited

U.S. PATENT DOCUMENTS 5,135,061 A * 8/1992 Newton, Jr. ..... B23B 27/148 175/379
5,335,738 A * 8/1994 Waldenstrom ..... C22C 29/08 175/420.2

(Continued)

FOREIGN PATENT DOCUMENTS

CN 101523014 A 9/2009
DE 10161713 B4 2/2004

(Continued)

OTHER PUBLICATIONS

Chinese Patent Application No. 201280045058.7, First Office Action mailed Mar. 2, 2015, 16 pages.

(Continued)

*Primary Examiner* — Sunil Singh
(74) *Attorney, Agent, or Firm* — Dean W. Russell; Clark F. Weight; Kilpatrick Townsend & Stockton LLP

(57) ABSTRACT

Tips for pick tools and pick tools comprising same are provided. The tip comprises an impact structure formed joined at a non-planar boundary surface of a substrate. The boundary surface includes a depression. The impact structure comprises super-hard material and has a working end including an apex opposite the depression. The boundary surface of the substrate comprises a ridge at the periphery of the depression and a generally tapered circumferential region depending away from the ridge towards a side of the tip, a lowest point of the depression being directly opposite the apex.

10 Claims, 7 Drawing Sheets

(51) Int. Cl.
*E21B 10/567* (2006.01)
*E21B 10/573* (2006.01)

(56) References Cited

U.S. PATENT DOCUMENTS

| | | | | |
|---|---|---|---|---|
| 5,379,854 | A * | 1/1995 | Dennis | E21B 10/5673 175/426 |
| 5,453,105 | A | 9/1995 | Middlemiss et al. | |
| 5,492,188 | A * | 2/1996 | Smith | B23B 27/145 175/432 |
| 5,494,477 | A | 2/1996 | Flood et al. | |
| 5,766,394 | A | 6/1998 | Anderson et al. | |
| 5,816,347 | A * | 10/1998 | Dennis | E21B 10/5735 175/432 |
| 5,871,060 | A * | 2/1999 | Jensen | E21B 10/5735 175/420.2 |
| 6,041,875 | A * | 3/2000 | Rai | E21B 10/5735 175/426 |
| 6,102,143 | A * | 8/2000 | Snyder | E21B 10/5735 175/432 |
| 6,179,886 | B1 | 1/2001 | Gordeev et al. | |
| 6,189,634 | B1 | 2/2001 | Bertagnolli et al. | |
| 6,342,301 | B1 * | 1/2002 | Yoshida | B01J 3/062 427/372.2 |
| 6,446,740 | B2 | 9/2002 | Eyre | |
| 6,447,852 | B1 | 9/2002 | Gordeev et al. | |
| 6,709,747 | B1 | 3/2004 | Gordeev et al. | |
| 6,919,040 | B2 | 7/2005 | Fries et al. | |
| 7,008,672 | B2 | 3/2006 | Gordeev et al. | |
| 7,588,102 | B2 | 9/2009 | Hall et al. | |
| 7,665,552 | B2 | 2/2010 | Hall et al. | |
| 8,028,774 | B2 | 10/2011 | Hall et al. | |
| 8,109,349 | B2 | 2/2012 | Hall et al. | |
| 2001/0004946 | A1 * | 6/2001 | Jensen | E21B 10/5673 175/428 |
| 2002/0062996 | A1 | 5/2002 | Dvorachek | |
| 2004/0026132 | A1 | 2/2004 | Hall et al. | |
| 2006/0119165 | A1 | 6/2006 | Holl et al. | |
| 2008/0035383 | A1 * | 2/2008 | Hall | E21C 35/183 175/414 |
| 2009/0051211 | A1 | 2/2009 | Hall et al. | |
| 2009/0133938 | A1 * | 5/2009 | Hall | C22C 26/00 175/434 |
| 2010/0065338 | A1 | 3/2010 | Hall et al. | |
| 2011/0132667 | A1 * | 6/2011 | Smallman | B01J 3/062 175/428 |

FOREIGN PATENT DOCUMENTS

| | | | |
|---|---|---|---|
| DE | 102004057302 | A1 | 6/2006 |
| EP | 0356097 | A2 | 2/1990 |
| GB | 2364082 | A | 1/2002 |
| GB | 2367081 | A | 3/2002 |
| GB | 2374618 | A | 10/2002 |
| GB | 2379697 | A | 3/2003 |
| GB | 2402410 | A | 12/2004 |
| WO | 2009013713 | A2 | 1/2009 |
| WO | 2011069637 | A1 | 6/2011 |

OTHER PUBLICATIONS

United Kingdom Patent Application No. GB1113013.5, Combined Search and Examination Report mailed Sep. 30, 2011, 7 pages.

United Kingdom Patent Application No. GB1213218.9, Combined Search and Examination Report, mailed Sep. 19, 2012, 6 pages.

International Patent Application No. PCT/EP2012/064609, International Search Report and Written Opinion mailed Dec. 11, 2013, 10 pages.

* cited by examiner

TIPS FOR PICK TOOLS AND PICK TOOLS COMPRISING SAME

CROSS REFERENCE TO RELATED APPLICATIONS

This application is the U.S. national phase of International Application No. PCT/EP2012/064609 filed on Jul. 25, 2012, and published in English on Jan. 31, 2013 as International Publication No. WO 2013/014192 A2, which application claims priority to Great Britain Patent Application No. 1113013.5 filed on Jul. 28, 2011 and U.S. Provisional Application No. 61/512,531 filed on Jul. 28, 2011, the contents of all of which are incorporated herein by reference.

The disclosure relates generally to tips for pick tools and to pick tools comprising same.

United States patent application publication number 2009/0051211 and U.S. Pat. No. 7,665,552 disclose a super-hard insert comprising a carbide substrate bonded to ceramic layer at an interface, in which the substrate comprises a generally frusto-conical end at the interface with a tapered portion leading to a flat portion. A central section of the ceramic layer comprises a first thickness immediately over the flat portion of the substrate and the peripheral section of the ceramic layer comprise a second thickness being less than the first thickness covering the tapered portion of the substrate. The flat portion of the interface may serve to substantially diminish the effects of failure initiation points in the insert.

Viewed from a first aspect there is provided a tip for a pick tool, comprising an impact structure formed joined at a non-planar boundary surface of a substrate, the boundary surface including a depression; the impact structure comprising super-hard material and having a working end including an apex opposite the depression; the boundary surface of the substrate comprising a ridge at the periphery of the depression and an intermediate region between the ridge and a peripheral edge of the substrate, the intermediate region depending away from the ridge (towards the peripheral edge of the substrate); a lowest point of the depression being directly opposite the apex, the apex and the lowest point of the depression directly opposite the apex defining a longitudinal axis passing through both.

Various arrangements and combinations are envisaged for tips and pick tools according to this disclosure, of which the following are non-limiting, non-exhaustive examples.

In some example arrangements, the intermediate region may be located between a top (a highest point) of the ridge or an edge of the ridge adjacent the depression (i.e. an inner edge of the ridge) and the peripheral edge of the substrate, the intermediate region depending away from the top of the ridge or the inner edge of the ridge, as the case may be, to or towards the peripheral edge of the substrate.

In some example arrangements, the longitudinal distance from the apex to a point on the circumferential region of the boundary surface may be substantially greater that the longitudinal distance from the apex to the lowest point of the depression, directly opposite the apex.

The intermediate region may be generally tapered, substantially non-tapered, flat or rounded. The intermediate region may include features such as dimples, flats, flutes and or protrusions, and or the intermediate region may include at least one oblique or radial intrusion into the depression. The boundary surface of the substrate may comprise a circumferential region depending away from the ridge. The intermediate region may comprise a circumferential region surrounding the depression and the ridge.

In some example arrangements, the ridge surrounds the depression, partly or substantially completely surrounding the depression. The ridge may be concentric with the depression. The ridge may define a ring that is substantially concentric with the longitudinal axis.

In some example arrangements, the ridge may comprise a series of structures or formations having different heights, in other words having different longitudinal distances from a lowest point of the depression. The ridge may comprise a series of structures having alternating height or the ridge may define a ring around the depression having a uniform height. The ridge may be circumferentially continuous or interrupted and the top of the ridge may be rounded or have a cornered edge, and the ridge may be generally circular or substantially non-circular. The ridge may partly be defined by an edge of the boundary surface of the substrate, although the ridge will not be entirely defined by the edge of the boundary surface of the substrate.

In some example arrangements, a proximate end of the substrate including the boundary surface may be described as being dome-like and having a hollow point (the hollow point being the depression).

In some example arrangements, the apex may be substantially pointed or the apex may be rounded. In some examples, the working end may have a rounded conical shape and the apex may define a radius of curvature in a longitudinal plane.

In some example arrangements, the depression may define a radius of curvature in a longitudinal plane. In some examples, the apex and the depression may each define a respective radius of curvature in a longitudinal plane, the radius of curvature of the depression being substantially less than that of the apex. In some examples, the radius of curvature of the depression may be substantially greater than that of the apex. For example, the depression may define a radius of curvature in a longitudinal plane of at least about 0.5 millimeters, and or the depression may define a radius of curvature in a longitudinal plane of at most about 10 millimeters or at most about 4 millimeters. In some examples, the radius of curvature of the apex may be at least about 1.5 millimeters or at least about 3 millimeters and at most about 4 millimeters, and the radius of curvature of the depression may be at least about 0.5 millimeters and at most about 4 millimeters. In some example arrangements, the depression may include a flat region, and or a protrusion or boss feature within it, and the depression may be generally circular or bowl-like, or it may be substantially non-circular when the viewed in a plan view.

In some example arrangements, the depression may have a depth of at least about 0.1 millimeter, at least 0.2 millimeter, at least about 0.3 millimeter or at least about 0.5 millimeter; and or the depression may have a depth of at most about 2 millimeters or at most about 1 millimeter, the depth being measured as the longitudinal distance between a highest point on the ridge and the lowest point of the depression, directly opposite the apex.

In some example arrangements, the impact structure may have a centre thickness between the apex and a point on the boundary surface at the depression, directly opposite the apex, and the depression may have a maximum lateral diameter less than the centre thickness, measured between diametrically opposite highest points on the ridge.

In some example arrangements, the impact structure may comprise diamond-containing material such as PCD material, thermally stable PCD material, SiC-bonded diamond or cemented carbide including diamond grains. The substrate may comprise cemented carbide material, such as cobalt cemented tungsten carbide material. In some examples, the impact structure may comprise PCD material formed joined to the substrate, the PCD material becoming joined to the substrate in the same sintering step in which the PCD material is formed by sintering together a plurality of diamond grains in the presence of a solvent and or catalyst material for promoting the sintering of diamond grains. In some examples, the PCD material may comprise diamond grains (as sintered) having a mean size of at least about 20 microns or at least about 30 microns and at most about 80 microns or at most about 50 microns; or the PCD material may comprise diamond grains having mean size in the range from about 0.1 micron to about 20 microns.

In some example arrangements, the impact structure may comprise a plurality of regions, each region comprising a different grade of the super-hard material or a different super-hard material.

In some example arrangements, the impact structure may comprise a plurality of alternating layers, adjacent layers each comprising a different grade of the super-hard material or a different super-hard material.

In some example arrangements, the boundary surface may be configured such that the impact structure includes a compressed volume in a residual state of axial (that is, longitudinal) compression, the compressed volume extending from the depression in the boundary surface to a region of the impact structure remote from boundary surface. For example, the compressed volume may be at least about 10 percent or at least about 20 percent of the volume of the tip, and or the axial (longitudinal) compression may be at least about 70 megapascal.

Viewed from a second aspect there is provided a pick comprising a tip according to this disclosure. In some example arrangements, the tip may be joined to a rod comprising cemented carbide material and the rod is shrink fit into a bore formed within a holder comprising steel.

Non-limiting example arrangements of tips and pick tools will now be described with reference to the accompanying drawings, of which:

Figure 1:
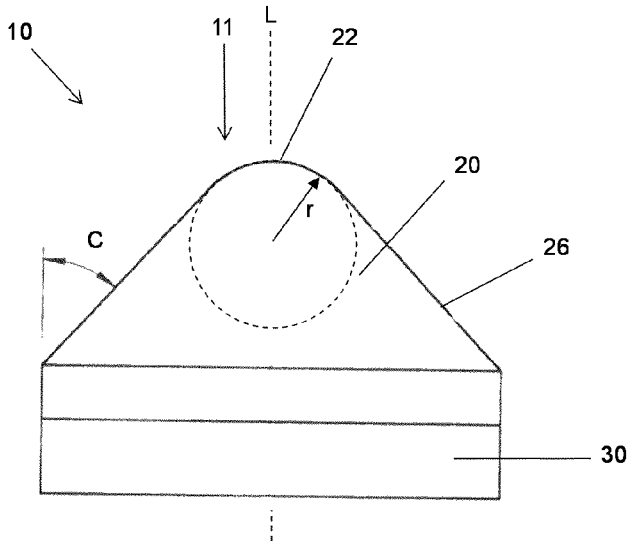
FIG. 1 shows a schematic side view of an example tip.

With reference to FIG. 1, an example tip 10 for a pick tool (not shown) comprises an impact structure 20 comprising PCD material formed joined to a proximate end of a substrate 30 comprising cemented carbide material. The impact structure 20 comprises a rounded (i.e. blunted) apex 22 and defines a working surface 26 at a working end 11, the apex 22 having a radius of curvature r in a longitudinal plane parallel to a longitudinal axis L. In some versions of the example, the radius of curvature r of the apex 22 may be from about 2.1 millimeters to about 2.3 millimeters, and in some versions of the example, the radius of curvature r of the apex 22 may be about 3.5 millimeters. The conical part of the working surface 26 may be inclined at an angle of about 42 degrees with respect to an axis parallel to the longitudinal axis L.

Figure 2:
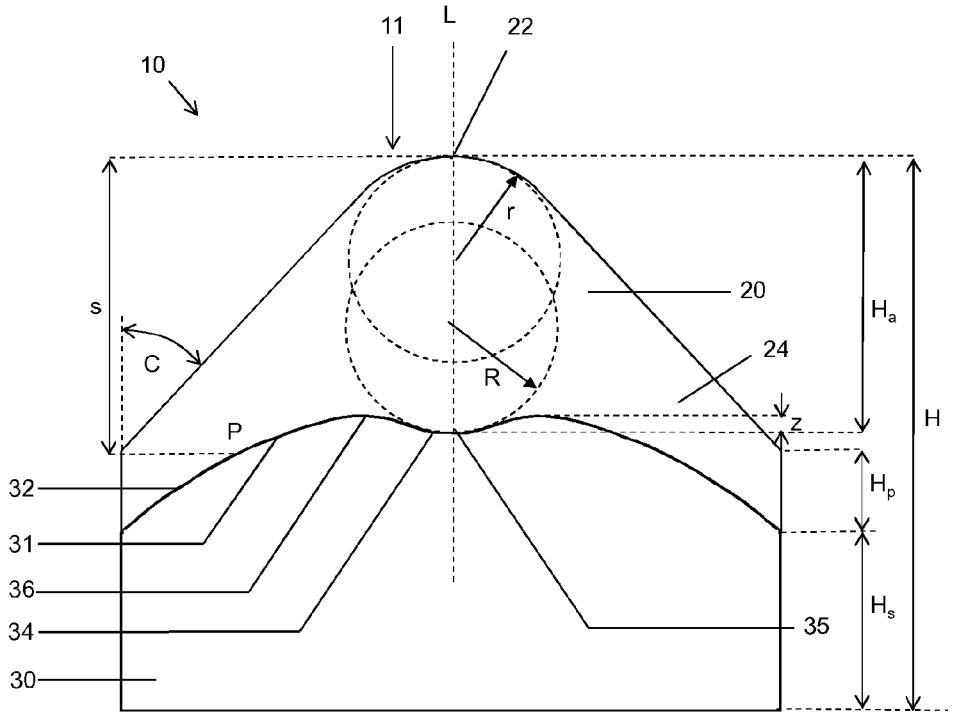
FIG. 2, FIG. 3 and FIG. 4 show schematic longitudinal cross section views through respective longitudinal planes of example tips.
Figure 3:
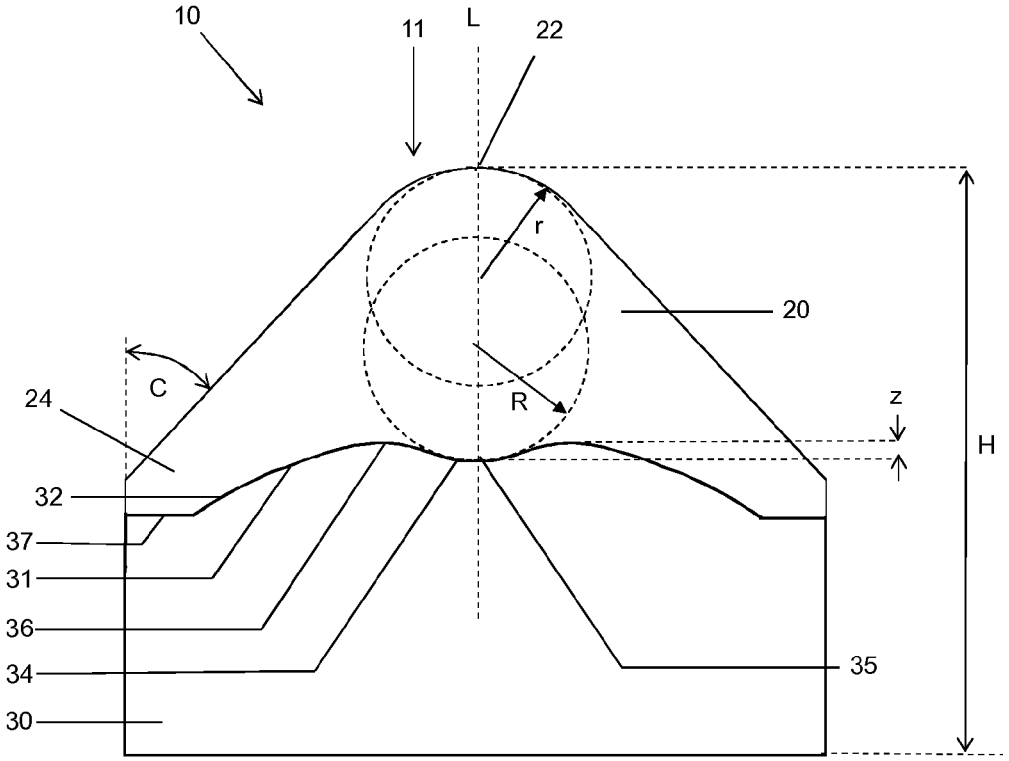

With reference to FIG. 2 and FIG. 3, example tips 10 comprise an impact structure 20 formed joined at a non-planar boundary surface 31 of a substrate 30, the boundary surface 31 including a depression 34. The impact structure 20 comprises PCD material and has a working end 11 including an apex 22 opposite the depression 34. The substrate 30 comprises cobalt cemented tungsten carbide material. The boundary surface 31 of the substrate 30 comprises a ridge 36 at the periphery of the depression 34 and a generally tapered circumferential intermediate region 32 depending away from the top of the ridge 36 towards a side of the tip 10. A lowest point 35 of the depression 34 is located directly opposite the apex 22, the apex 22 and the lowest point of the depression 35 defining a longitudinal axis L passing through both. In the particular example shown in FIG. 2, the working end 11 of the tip 10 has the shape of a spherically blunted cone, the apex 22 of which has a radius of curvature r in the longitudinal plane of about 3.5 millimeters. The depression 34 has a radius of curvature R of about 1 millimeter and a depth of about 0.28 millimeters, measured as the longitudinal distance z between a highest point on the ridge 36 and the lowest point 35 of the depression 34. The impact structure 20 has a centre height $H_a$ of about 4.3 millimeters, measured from the apex 22 to the lowest point 35 of the depression 34. With reference to FIG. 2, at least one point P on the intermediate region 32 has a longitudinal distance s greater than the longitudinal distance between the apex 22 and the lowest point 35 of the depression 34. In the particular example shown in FIG. 3, the boundary surface of an example tip arrangement 10 comprises a shoulder region 37 between a tapering circumferential intermediate region 32 and a peripheral edge of the substrate 30.

With further reference to FIG. 2 and FIG. 3, the impact structure 20 comprises a skirt portion 24 and defines a working surface 26 having the general shape of a rounded or blunted cone. The conical part of the working surface 26 is inclined at an angle C of about 43 degrees with respect to an axis parallel to the longitudinal axis L. The impact structure has a height $H_a$ from the apex 22 to the bottom 35 of the depression 34 of at least about 3 millimeters and at most about 8 millimeters. The substrate 30 has a cylindrical side connecting the proximate end to a distal end the length $H_s$ of the side may be at least about 1 millimeter and at most about 3 millimeters. The diameter of the substrate may be at least about 9 millimeters and at most about 16 millimeters and the height H of the tip from the apex 22 to a distal end of the substrate 30 may be at least about 6 millimeters and at most about 12 millimeters.

The skirt portion 24 may extend to the side of the substrate 30 and have a cylindrical side surface portion having a length $H_p$ of at least about 1 millimeters and at most about 3 millimeters.

Figure 4:
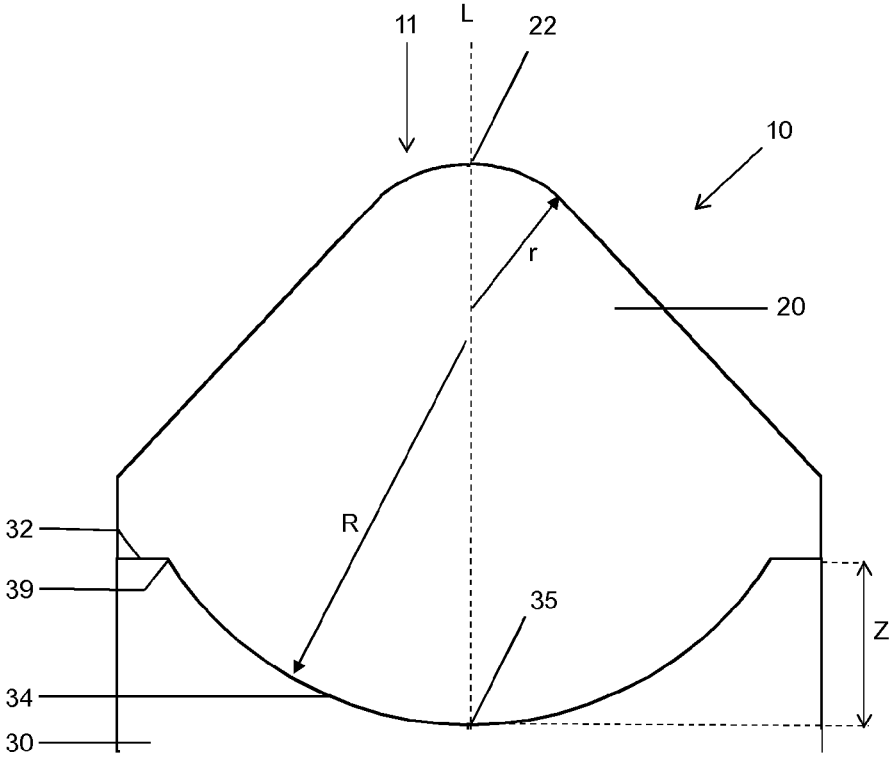

With reference to FIG. 4, an example tip 10 comprises an impact structure 20 formed joined at a non-planar boundary surface of a substrate 30, the boundary surface including a depression 34. The impact structure 20 comprises PCD material and has a working end 11 including an apex 22 opposite the depression 34. The substrate 30 comprises cobalt cemented tungsten carbide material. The boundary surface of the substrate 30 comprises a ridge having an inner edge 39 adjacent the depression 34 and an intermediate region 32 depending away from the inner edge 39 of the ridge to a side of the tip 10. A lowest point 35 of the depression 34 is located directly opposite the apex 22, the apex 22 and the lowest point of the depression 35 defining a longitudinal axis L passing through both.

A mathematical method of finite element analysis (FEA) may be used to calculate the stress field within the impact structures, given the design of the tip and certain physical properties of the impact structure material and the material of the substrate. FEM is a numerical technique for finding approximate solutions of complex equations by dividing a body into many smaller notional volumes of simpler shapes and carrying out the calculations for each volume, ensuring that the conditions at the boundaries between the volumes is consistent. In the case of tips in which the impact structure comprises PCD material formed joined at an ultra-high pressure to a substrate comprising cemented carbide material, a "birth condition" for the tip is used. The birth condition is the presumed pressure and temperature at which the PCD becomes bonded to the substrate and substantially the whole of the tip is in the solid state (i.e. the catalyst material that had been molten when the PCD material formed solidifies at the birth condition of the tip). It is assumed that the all components of stress throughout the impact structure are substantially uniform and compressive at the birth condition. As the temperature and pressure are reduced from the birth condition to ambient conditions, the impact structure and the substrate to which it is joined will tend to shrink at different rates owing to their different material properties such as the Young's (or elastic) modulus and the coefficient of thermal expansion (CTE). This results in a substantial amount of residual stress within the tip at temperatures and pressures less than those of the birth condition. At each point within the tip the stress will have different components, namely an axial (longitudinal), hoop (circumferential) and radial components, each of which may be compressive or tensile. It is expected that cracks may tend to propagate more easily through regions in a state of tensile stress (which may be viewed as a kind of "pulling" stress).

In the example arrangements illustrated in FIG. 5A and FIG. 5B, FIG. 6A and FIG. 6B, and FIG. 7A and FIG. 7B, the proximate ends of the substrates 30, and consequently the boundary surfaces of the substrates 30, are configured such that there are respective central compressed zones 28 in a state of residual (i.e. unloaded) axial compression at ambient temperature (about 25 degrees Celsius) within the PCD structures 20, the axially (longitudinally) compressed zones extending substantially from the depressions 34 at the boundary surface to a remote central region of the super-hard structure 20. A plurality of small protrusions 39 may be provided on the tapered surface region 32, which may reduce the risk of the PCD structure 20 becoming detached from the substrate 30.

In general and all else being equal, as the depth z of the depression increases the magnitude of compression within the compressed zone of the impact structure is also likely to tend to increase. However, the magnitude of tension within an adjacent zone in the substrate is also likely to increase. Therefore, a design consideration will be to find a depression depth that increases the magnitude of the residual axial compressive stress within the impact structure adjacent the depression while keeping the tensile stress in the substrate sufficiently low. An optimum trade-off is likely to depend on various aspects of the tip design, such as the shape of depression and its radius of curvature.

In general and all else being equal, as the radius of curvature R of the depression is increased, the volume of the zone in residual axial compression is likely to increase. However, while wishing not to be bound by a particular theory, if the radius R is increased too much than the axially compressed zone may be likely to weaken and separate from the boundary between the impact structure and the substrate. For example, when the radius R approaches infinity (i.e. approaching a flat surface arrangement) the axially stressed zone may cease to extend from the boundary at the depression to a region remote from the boundary. If the radius of curvature is too small, the volume of the compressed zone may be too small, likely resulting in a relatively high magnitude of the compressive stress being distributed over a relatively small volume. If the radius is too large, a relatively weak compressive stress is likely to be distributed over a relatively large volume. Therefore, a design consideration will be to find a radius of curvature for which the magnitude of the compression and the volume of the compressed zone are both sufficiently high, given other design aspects such as the depth of the depression.

Figure 8:
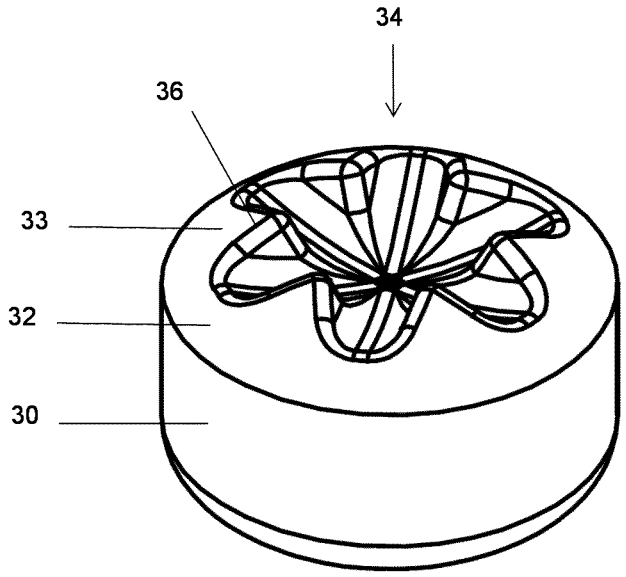
FIG. 8 shows a schematic perspective view of an example substrate for a tip.

Various example configurations are envisaged for the boundary surface at the proximate end of the substrate. For example, the example substrate 30 shown in FIG. 8 has a proximate end including a depression 34 defined by a ridge 36 and a generally tapering surface region 32 depending from the ridge 36 to the side of the substrate 30. The ridge 36 is substantially non-circular the tapering region 32 includes a plurality (six, in this example) of generally radial intrusions 33 into the depression, the intrusions 33 arranged around the depression 34 substantially equidistantly.

Figure 9:
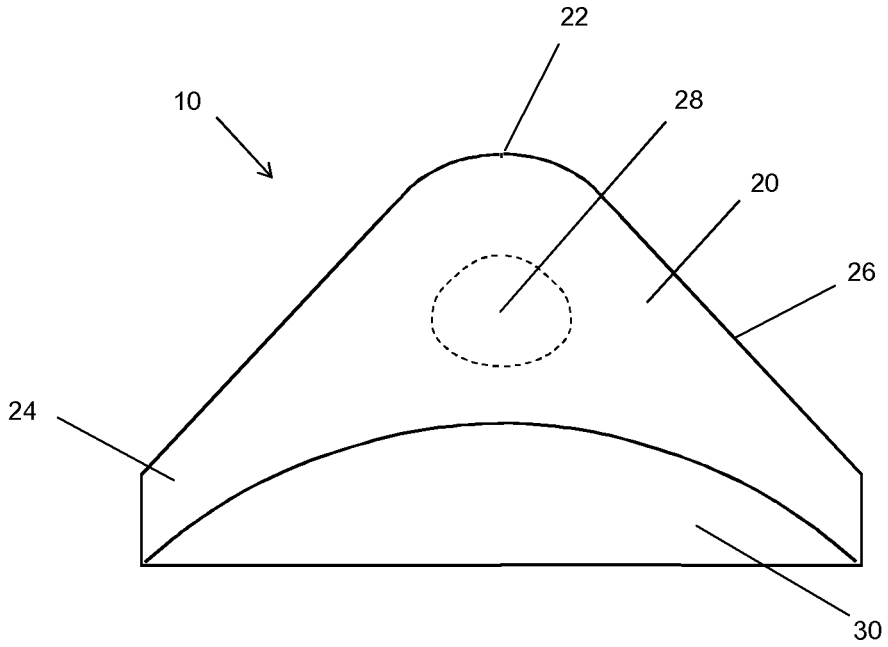
FIG. 9 shows a schematic longitudinal cross section view through the centre of an example comparative tip for a pick tool.

With reference to FIG. 9, a comparative example tip 10 comprises a PCD impact structure 20 formed joined to a cemented carbide substrate 30 at a convex domed boundary without a depression. The impact structure 20 has a generally blunted conical working surface 26 including a rounded apex 22 and comprises a skirt portion 24. A generally spherical central axially compressed zone 28 is evident from FEA calculation, but it is not connected with the boundary surface.

Example tips may be for a pick tool for a road milling apparatus, generally as disclosed in United States patent application publication number 2010065338 and various arrangements and combinations of features are envisaged. For example: the tip may comprise a PCD structure bonded to a cemented metal carbide substrate at a non-planar interface, in which the PCD structure may have a working end having the general shape of a rounded cone with an apex having 1.3 millimeters to 3.2 millimeters radius of curvature, longitudinally (i.e. in a plane through the apex); and or the PCD structure may have a 2.5 millimeters to 12 millimeters thickness from the apex to the interface; and or the PCD structure may have a side which forms a 35 degree to 55 degree angle with a central longitudinal axis of the tip (in one example, the angle may be substantially 45 degrees); and or the PCD structure may have a volume in the range from 75 percent to 150 percent of the volume of the carbide substrate.

Figure 10:
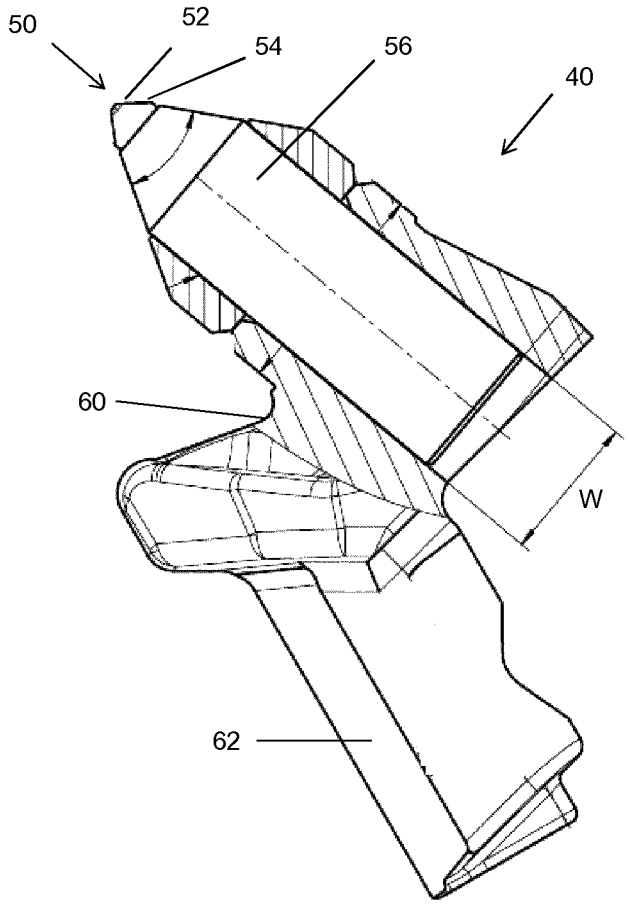
FIG. 10 shows a schematic partly cut-away side view of an example pick tool for a road pavement degradation apparatus.

With reference to FIG. 10, an example pick tool 40 for road pavement degradation comprises an insert 50 shrink-fit within a steel holder 60. The insert 50 may comprise a tip 52 joined to a cemented carbide segment 54, which is joined to a shaft 56, a major part of the shaft 56 being held in compression within a bore formed within the holder 60. The holder comprises a coupler shank 62 for coupling the holder 60 to a drum apparatus (not shown).

An example method of making a tip comprising an impact structure comprising PCD material formed joined to a cemented carbide substrate will be described. A substrate having substantially cylindrical side surface connecting a proximate end and a distal end may be provided, in which the proximate end will be the boundary surface and includes a generally central depression defined by a ridge, and a generally tapered circumferential region extending away from the ridge towards the side. The substrate may be sintered with substantially the desired shape. A cup may be provided for use in assembling an aggregation comprising a plurality of diamond grains and a substrate. The diamond grains may have a mean size of at least about 0.1 micron and or at most about 75 microns and may be substantially mono-modal or multi-modal. The aggregation may comprise substantially loose diamond grains or diamond-containing pre-cursor structures such as granules, discs, wafers or sheets. The aggregation may also include catalyst material for diamond or pre-cursor material for catalyst material, which may be admixed with the diamond grains and or deposited on the surfaces of the diamond grains. The aggregation may contain additives for reducing abnormal diamond grain growth or the aggregation may be substantially free of catalyst material or additives. Alternatively or additionally, another source of catalyst material such as cobalt may be provided, such as the binder material in the cemented carbide substrate. The cup may have an interior surface configured generally to have the shape desired for the working surface of the impact structure. A sufficient quantity of the diamond-containing pre-cursor structures may be placed into the cup and then the substrate may inserted into the cup with the proximate end going in first and pushed against the diamond-containing pre-cursor structures, causing them to move slightly and position themselves according to the shape of the non-planar end of the support body. A pre-sinter assembly comprising diamond, a substrate and a catalyst material may thus be formed, placed into a capsule for an ultra-high pressure press and subjected to an ultra-high pressure of at least about 5.5 gigapascal or at least about 7 gigapascal and a high temperature of at least about 1,300 degrees Celsius to sinter the diamond grains and form a PCD impact structure integrally joined to the substrate.

Aggregations of diamond grains may be provided in the form of sheets containing diamond grains held together by a binder material such as a water-based organic binder may be provided. The sheets may be made by a method known in the art, such as by extrusion or tape casting methods, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. The sheets may also contain catalyst material for diamond, such as cobalt, and or additives for inhibiting abnormal growth of the diamond grains or enhancing the properties of the PCD material. For example, the sheets may contain about 0.5 weight percent to about 5 weight percent of vanadium carbide, chromium carbide or tungsten carbide. In one example, each of the sets may comprise about 10 to 20 discs. Alternative methods for depositing diamond-bearing layers onto a boundary surface of a substrate may include spraying methods, such as thermal spraying.

Different sheets comprising diamond grains having different size distributions, diamond content or additives may be provided, suitable for making different grades of PCD material. For example, at least two sheets comprising diamond having different mean sizes may be provided and first and second sets of discs may be cut from the respective first and second sheets. The discs may be stacked on the boundary surface in an alternating arrangement in order to provide an impact structure comprising alternating layers of different PCD grades.

Example methods may further include processing the tip by grinding to modify its shape. Catalyst material may be removed from a region of the PCD structure adjacent the working surface or the side surface or both the working surface and the side surface. This may be done by treating the PCD structure with acid to leach out catalyst material from between the diamond grains, or by other methods such as electrochemical methods. A thermally stable region, which may be substantially porous, extending a depth of at least about 50 microns or at least about 100 microns from a surface of the PCD structure, may thus be provided. In one example, the substantially porous region may comprise at most 2 weight percent of catalyst material.

A holder for a pick tool as disclosed may be attached to a base block (carrier body) by means of an interlocking fastener mechanism in which a shaft of the holder is locked within a bore formed within the carrier body. The shaft may be releasably connectable to the base block welded or otherwise joined to the drum. The base block and holder, more specifically the shaft of the holder, may be configured to permit releasable inter-engagement of the steel holder and base block. The shaft may be configured to inter-engage non-rotationally with a base block, and may be suitable for use with tool carriers disclosed in German patents numbers DE 101 61 713 B4 and DE 10 2004 057 302 A1, for example. The tool carrier, such as a base block, may be welded onto a component of a drive apparatus, such as a drum, for driving the super-hard pick tool. Other types and designs of tool carriers may also be used, the holder being correspondingly configured for coupling.

In operation, the pick tool may be driven forward by a drive apparatus on which it is mounted, against a structure to be degraded and with the tip at the leading end. For example, a plurality of pick tools may be mounted on a drum for asphalt degradation, as may be used to break up a road for resurfacing. The drum is connected to a vehicle and caused to rotate. As the drum is brought into proximity of the road surface, the pick tools are repeatedly impacted into the road as the drum rotates and the leading tips thus break up the asphalt. A similar approach may be used to break up coal formations in coal mining.

Non-limiting example arrangements of tips are shown in the table below with reference to FIG. 2, and Examples 1, 2 and 3 are described in more detail.

EXAMPLE 1

A substrate for a tip comprising a PCD impact structure may be provided by forming a green body comprising a compacted blend of about 8 weight percent Co and 92 weight percent WC grains, machining the green body to the desired shape and sintering the green body to form a substrate comprising cemented carbide material. The substrate may have a proximate end configured as a hollow-point dome, in which a generally dome-shaped end includes a central, substantially circular depression at the nose. The depression may have a depth z of about 0.3 millimeters measured from the top of a surrounding, circular ridge, and it may have a radius of curvature R in a longitudinal plane through the centre of the depression of about 1 millimeters. The proximate end will comprise a circumferential tapering surface region extending from the ridge to a cylindrical side surface of the substrate, and a plurality of small protrusions may be formed on the tapering surface. The top of the ridge will be rounded.

Aggregations of diamond grains may be provided in the form of a sheet containing diamond grains held together by a binder material may be provided. The sheet will comprise diamond grains having a mean size of about 20 microns and be made by means of a tape casting method. The sheet may be broken into fragments. The fragments may be placed into a cup, the inside of which will define the desired shape of the working surface of the impact structure (taking into account expected distortion that may occur during sintering), and the proximate end of the substrate may be inserted into the cup and urged against the diamond-containing fragments to form a pre-sinter assembly. The pre-sinter assembly may be outgassed under heat in order to burn off the binder material comprised in the fragments, placed into a capsule for an ultra-high pressure press and subjected to an ultra-high pressure of at least about 6 gigapascal and a high temperature of at least about 1,300 degrees Celsius to sinter the diamond grains to form a compact comprising PCD impact structure joined to the substrate. The compact may be removed from the capsule and further processed to final dimensions to provide a tip for a pick tool.

Figure 5A:
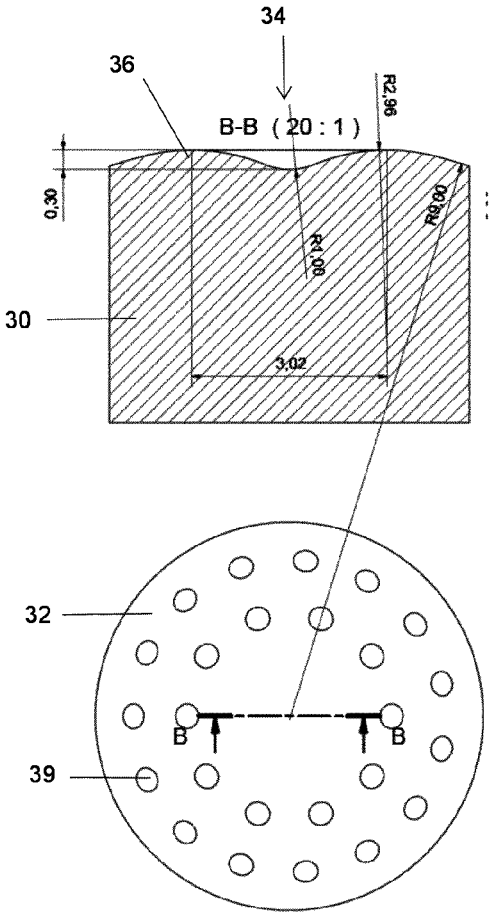
FIG. 5A shows a schematic longitudinal cross section through an example substrate along the line B-B indicated in the accompanying plan view of the substrate.
Figure 5B:
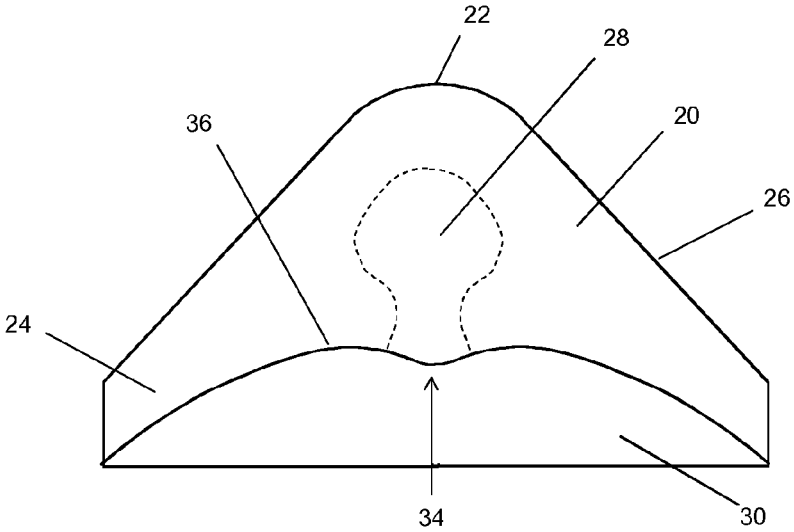
FIG. 5B shows a schematic longitudinal cross section through an example tip comprising the substrate of FIG. 5A, illustrating a calculated volume of residual axial stress.

It is estimated that impact structure would have a Young's modulus of about 1,036 gigapascal, a Poisson ratio of about 0.105 and a coefficient of thermal expansion of about $3.69\times10^{-6}$ per degree Celsius; and that the substrate would have a Young's modulus of about 600 gigapascal, a Poisson ratio of about 0.21 and a coefficient of thermal expansion of about $5.7\times10^{-6}$ per degree Celsius. Using finite element mathematical analysis, it was calculated that the impact structure would include a region of residual axial compressive stress as shown in FIG. 5B.

| | Example | | | | |
|---|---|---|---|---|---|
| Design parameter | 1 | 2 | 3 | 4 | 5 |
| Overall height H, millimetres | 9 | 9 | 9 | 9 | 9 |
| Diameter D, millimetres | 12 | 12 | 12 | 12 | 12 |
| Impact structure thickness at apex $H_a$, millimetres | 5.3 | 5.3 | 5.3 | 4.3 | 4.85 |
| Impact structure thickness at periphery $H_p$, millimetres | 1.5 | 1.5 | 1.5 | 1.0 | 1.0 |
| Apex radius of curvature r, millimetres | 2.25 | 2.25 | 2.25 | 3.5 | 3.5 |
| Impact structure working surface angle C, degrees | 43 | 43 | 43 | 43 | 43 |
| Impact structure volume, cubic millimetres | 275 | 275 | 275 | 237 | 290 |
| Substrate thickness at apex, millimetres | 3.715 | 3.715 | 3.715 | 4.69 | 4.15 |
| Substrate thickness at periphery $H_p$, millimetres | 2.115 | 2.115 | 2.115 | 3.2 | 3.2 |
| Depression radius of curvature R, millimetres | 1.0 | 2.5 | 5 | 1.0 | 1.0 |
| Depression depth z, millimetres | 0.3 | 0.3 | 0.3 | 0.28 | 0.28 |
| Substrate volume, cubic millimetres | 374 | 374 | 374 | 473 | 420 |

EXAMPLE 2

Figure 6A:
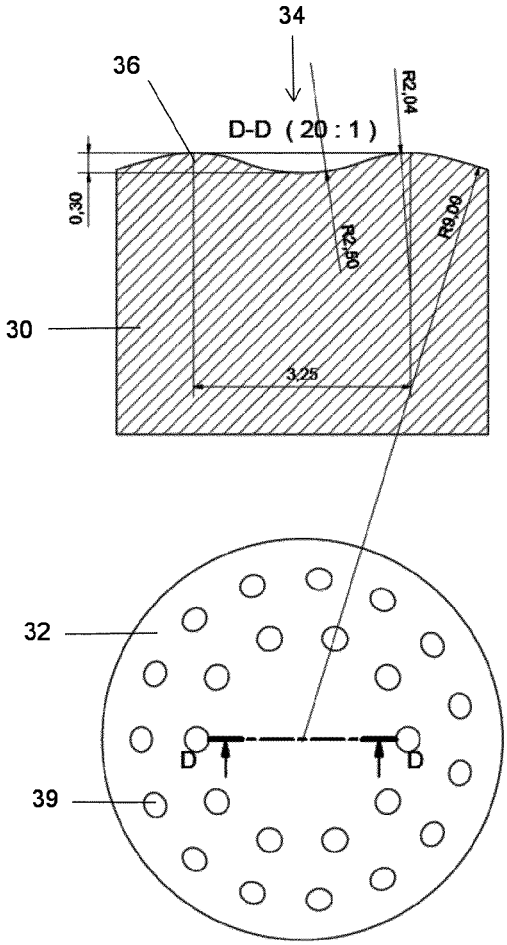
FIG. 6A shows a schematic longitudinal cross section through an example substrate along the line D-D indicated in the accompanying plan view of the substrate.
Figure 6B:
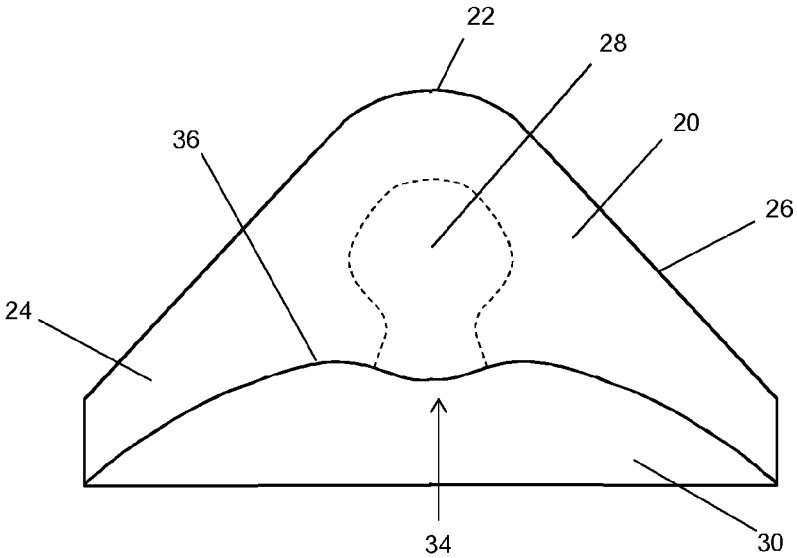
FIG. 6B shows a schematic longitudinal cross section an example tip comprising the substrate of FIG. 6A, illustrating a calculated volume of residual axial stress.

A tip may be made as described in Example 1, except that the depression has a radius of curvature R of about 2.5 millimeters. Using finite element mathematical analysis, it was calculated that the impact structure would include a region of residual axial compressive stress as shown in FIG. 6B.

EXAMPLE 3

Figure 7A:
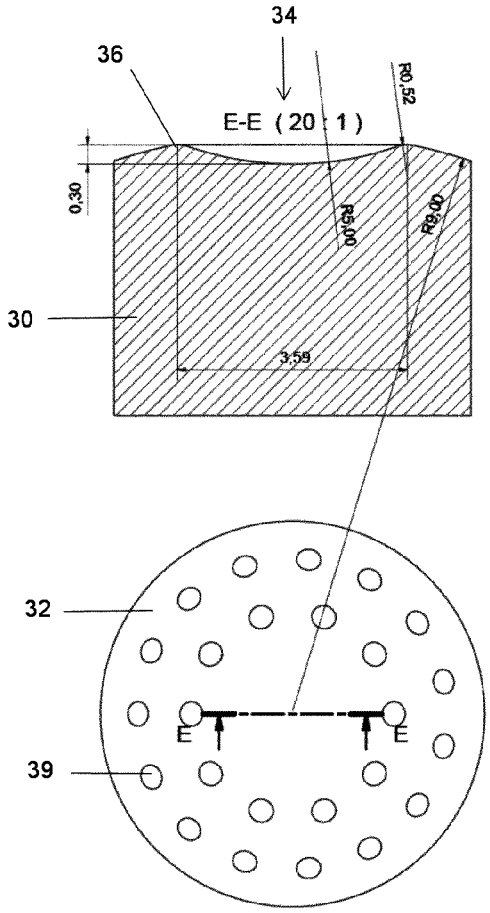
FIG. 7A shows a schematic longitudinal cross section through an example substrate along the line E-E indicated in the accompanying plan view of the substrate.
Figure 7B:
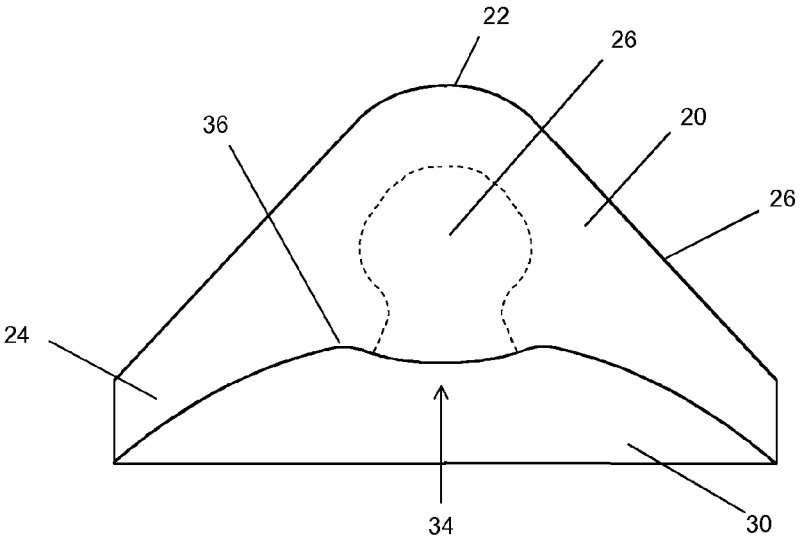
FIG. 7B shows a schematic longitudinal cross section through an example tip comprising the substrate of FIG. 7A, illustrating a calculated volume of residual axial stress.

A tip may be made as described in Example 1, except that the depression has a radius of curvature R of about 5 millimeters. Using finite element mathematical analysis, it was calculated that the impact structure would include a region of residual axial compressive stress as shown in FIG. 7B.

While wishing not to be bound by a particular theory, disclosed tip arrangements may have enhanced resistance to crack propagation resulting at least in part from the configuration of residual axial compressive stress arising from the depression in the boundary surface of the substrate. This compressive stress may function to resist the propagation of cracks from the working surface of the impact structure towards the substrate and or towards an opposite side of the impact structure. Cracks may initiate proximate the working surface of the impact structure as a result of a bending moment applied to the impact structure as it strikes a body off-centre in use.

Disclosed tip arrangements may have the aspect of enhanced fracture resistance and disclosed picks may have the aspect of extended working life.

Certain terms as used herein are briefly explained below.

As used herein, "super-hard" means a Vickers hardness of at least 25 gigapascal. Synthetic and natural diamond, polycrystalline diamond (PCD), cubic boron nitride (cBN) and polycrystalline cBN (PCBN) material are examples of superhard materials. Synthetic diamond, which is also called man-made diamond, is diamond material that has been manufactured. As used herein, PCBN material comprises grains of cubic boron nitride (cBN) dispersed within a matrix comprising metal and or ceramic material. PCD material comprises a mass (an aggregation of a plurality) of diamond grains, a substantial portion of which are directly inter-bonded with each other and in which the content of diamond is at least about 80 volume percent of the material. Interstices between the diamond grains may be at least partly filled with a binder material comprising a catalyst material for synthetic diamond, or they may be substantially empty. Catalyst material for synthetic diamond is capable of promoting the growth of synthetic diamond grains and or the direct inter-growth of synthetic or natural diamond grains at a temperature and pressure at which synthetic or natural diamond is thermodynamically more stable than graphite. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains. Various grades of PCD material may be made. As used herein, a PCD grade is a variant of PCD material characterised in terms of the volume content and size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

Thermally stable PCD material comprises at least a part or volume of which exhibits no substantial structural degradation or deterioration of hardness or abrasion resistance after exposure to a temperature above about 400 degrees Celsius, or even above about 700 degrees Celsius. For example, PCD material containing less than about 2 weight percent of catalyst metal for diamond such as Co, Fe, Ni, Mn in catalytically active form (e.g. in elemental form) may be thermally stable. PCD material that is substantially free of catalyst material in catalytically active form is an example of thermally stable PCD. PCD material in which the interstices are substantially voids or at least partly filled with ceramic material such as SiC or salt material such as carbonate compounds may be thermally stable, for example. PCD structures having at least a significant region from which catalyst material for diamond has been depleted, or in which catalyst material is in a form that is relatively less active as a catalyst, may be described as thermally stable PCD.

Other examples of super-hard materials include certain composite materials comprising diamond or cBN grains held together by a matrix comprising ceramic material, such as silicon carbide (SiC), or cemented carbide material, such as Co-bonded WC material (for example, as described in U.S. Pat. Nos. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

As used herein, a super-hard structure formed joined to a substrate comprises super-hard material, particularly sintered polycrystalline material, that becomes joined to the substrate in the same sintering step in which the super-hard material is formed by sintering. For example, polycrystalline super-hard material may be formed joined to a substrate by a method including providing the substrate comprising catalyst and or solvent material capable of promoting the sintering of the super-hard material at a pressure and temperature at which the super-hard material is thermodynamically stable, providing an aggregation comprising a plurality of grains of super-hard material, contacting the aggregation with a surface of the substrate and subjecting the aggregation and the substrate to the pressure and temperature to sinter the super-hard grains to form the polycrystalline super-hard material, which will be joined to the substrate in the sintering process.

As used herein, the longitudinal distance between two given points on or within the tip is the longitudinal component of the distance between them, the longitudinal component being parallel to the longitudinal axis. A longitudinal plane is a plane that is substantially parallel to the longitudinal axis. A lowest point of the depression is a point lying on the bottom of the depression, such that no other point on the depression (that is, within that area of the boundary surface defining the depression) has a greater longitudinal distance from the apex than does the point at the bottom of the depression. In examples where a region at the bottom of the depression is flat, points at the bottom of the depression may not be unique. In examples where the depression is concavely semi-hemispherical in shape (which may be referred to as bowl-like in shape), the point at the bottom of the depression will be unique and will be directly opposite the apex.

The invention claimed is:

1. A tip for a pick tool, comprising an
impact structure formed joined at
a non-planar boundary surface of
a substrate comprising cemented carbide material;
the boundary surface
including a depression and comprising
a ridge at the periphery of the depression and
an intermediate region between the ridge and a peripheral edge of the substrate,
the intermediate region depending away from the ridge;
the impact structure comprising
polycrystalline diamond (PCD) material and
a working end having a rounded conical shape, including an apex opposite the depression;
a lowest point of the depression being directly opposite the apex,
the apex and the lowest point of the depression directly opposite the apex defining
a longitudinal axis passing through both;
the apex
defining a radius of curvature in a longitudinal plane of at least 1.5 millimeters; and
the depression
defining a radius of curvature in the longitudinal plane of at least 0.5 millimeter, and
having a depth of 0.1 to 2 millimeters, measured as the longitudinal distance between a highest point on the ridge and the lowest point of the depression.

2. A tip as claimed in claim 1, in which the longitudinal distance from the apex to a point on the intermediate region of the boundary surface is substantially greater that the longitudinal distance from the apex to the lowest point of the depression.

3. A tip as claimed in claim 1, in which the ridge surrounds the depression.

4. A tip as claimed in claim 1, in which the radius of curvature of the depression is less than that of the apex.

5. A tip as claimed in claim 1, in which the depression defines a radius of curvature in a longitudinal plane of at most 10 millimeters.

6. A tip as claimed in claim 1, in which the impact structure has a centre thickness between the apex and the boundary surface at the depression, the depression having a maximum lateral diameter less than the centre thickness.

7. A tip as claimed in claim 1, in which the boundary surface is configured such that the impact structure includes a compressed volume in a residual state of axial compression, the compressed volume extending from the depression in the boundary surface to a region of the impact structure remote from boundary surface.

8. A tip as claimed in claim 7, in which the compressed volume is at least 10 percent the volume of the tip.

9. A tip as claimed in claim 8, in which the axial compression is at least 70 megapascals.

10. A pick comprising a tip as claimed in claim 1.

* * * * *